US005689978A

United States Patent [19]

Eklof et al.

[11] Patent Number: 5,689,978

[45] Date of Patent: Nov. 25, 1997

[54] SECURITY LOCK FOR MERCHANDISE DISPLAY HOOKS

[75] Inventors: Thomas Elwood Eklof; Walter Matt Poterbin, both of Santa Cruz County, Calif.

[73] Assignee: Santa Cruz Industries, Santa Cruz, Calif.

[21] Appl. No.: 506,235

[22] Filed: Jul. 24, 1995

[51] Int. Cl.[6] ..... E05B 73/00

[52] U.S. Cl. ..... 70/62; 70/58; 211/4; 211/7

[58] Field of Search ..... 211/4, 7, 57.1, 211/59.1; 70/14, 18, 57, 58, 61, 62, 46, 417, 52, 39, 38 A, 38 B, 38 C

[56] References Cited

U.S. PATENT DOCUMENTS

| | | | |
|---|---|---|---|
| 1,022,980 | 4/1912 | Stringer . | |
| 1,206,769 | 11/1916 | Wheary . | |
| 3,655,061 | 4/1972 | Peschcke-Koedt | 211/57 |
| 3,735,875 | 5/1973 | Parillo | 211/7 |
| 3,827,569 | 8/1974 | Canning | 211/7 |
| 4,289,242 | 9/1981 | Kenyon | 211/4 |
| 4,953,371 | 9/1990 | Appelbaum | 70/32 |
| 5,018,627 | 5/1991 | Moore | 211/7 X |
| 5,027,622 | 7/1991 | Hatch et al. | 70/14 |
| 5,259,220 | 11/1993 | Fredrickson | 211/7 X |
| 5,275,027 | 1/1994 | Eklof et al. | 211/4 X |
| 5,517,835 | 5/1996 | Smith | 70/58 X |

*Primary Examiner*—Suzanne Dino

*Attorney, Agent, or Firm*—Flehr Hohbach Test Albritton & Herbert LLP

[57] ABSTRACT

A lock is disclosed for securing merchandise products onto a hook of the type adapted for mounting onto a pegboard or other support. The lock includes a housing having an internal cavity which is formed with a cradle for seating the tip of the hook. A slot formed in the housing enables ingress and egress of the hook tip toward and away from a seated position in the cradle. A latch is pivotally mounted in the housing and the latch is moveable to a latched position at which the hook tip is captured in its seated position in the cradle. The latch is releasably held in its latched position by a nib on the housing which engages a depression on the latch. Operation of a key causes the latch to pivot toward an unlatched position at which the hook tip is enabled to be unseated from the cavity for egress out of the cavity, permitting the lock to be separated from the hook.

1 Claim, 3 Drawing Sheets

SECURITY LOCK FOR MERCHANDISE DISPLAY HOOKS

BACKGROUND OF THE INVENTION

1. Field of the Invention

This invention relates in general to apparatus for displaying merchandise on hooks attached to pegboards or other supports. Retail stores and supermarkets typically employ pegboards and hook assemblies to provide attractive displays of relatively small merchandise products. These products are usually packaged on card stock which is punched with holes for mounting on the hooks.

Pegboard type hooks provide for a uniform and attractive display of the products for customer appeal. However, pilferage and theft is a problem because it is relatively easy for the products, because of their relatively small size, to be removed from the hooks by shoplifters. This can add up to a relatively large monetary loss to retailers, and the loss is regularly passed on to consumers in the form of higher prices.

2. Background Art

Various devices have been proposed in the prior art in an effort to minimize theft from pegboard type displays. Among this prior art is U.S. Pat. No. 5,027,622 to Hatch which provides a key-operated lock for holding a cover plate in place over the rod of a pegboard hook. When in place the lock is not rigidly secured to the hook in that it can undergo both longitudinal and rotational movement on the hook. The lock also leaves exposed the upturned tip of the hook, which is objectionable because the exposed tip can cause eye injuries. Additionally, in the Hatch patent the rod of the hook also penetrates through the front face of the lock such that there is no uniform flat surface facing the customer for receiving printed information such as product descriptions, store logos and the like.

Another anti-theft device for a pegboard hook is provided in U.S. Pat. No. 3,665,061 to Peschcke-Koedt, but the device requires that the packaging for the merchandise product be of special design, which increases the cost and limits its range of use. U.S. Pat. No. 4,953,371 to Appelbaum provides a padlock with a latching head which is specially shaped, in one embodiment, to fit around the U-shaped arm of a hasp-type lock. In another embodiment of the Appelbaum patent a specially grooved pin is required to lock with the latching head, which limits the scope of use of the device. U.S. Pat. No. 1,022,980 to Stringer provides a clothes hanger locking device, but a special key is required both for opening and closing the device. U.S. Pat. No. 1,206,769 to Wheary provides a locking device in which a special key is also required both for opening and closing it.

The need has therefore been recognized for a new and improved security lock for use in holding merchandise products onto pegboard type hooks. It is desirable to provide a lock which is relatively simple and inexpensive to manufacture, which is fixedly held in place on the tip of the hook in a manner which covers the sharp hook tip to protect against injuries, which provides an unimpeded flat indicia-receiving surface facing customers, which can be easily unlocked with a simple key, and which can be easily relocked onto the hook without the need for a key. Despite the various types of pegboard hook locks in the prior art, there has not yet been provided a suitable and attractive solution to these problems.

OBJECTS AND SUMMARY OF THE INVENTION

It is a general object of the present invention to provide a new and improved security lock for use in securing merchandise products onto pegboard type hooks for minimizing pilferage and theft.

Another object is to provide a security lock of the type described which is fixedly mounted on the end of the hook tip in a manner which protects against injuries.

Another object is to provide a security lock of the type described which is fixedly mounted on the hook tip and presents a uniformly flat indicia-receiving surface that faces the customers.

Another object is to provide a security lock of the type described which can be easily unlocked by a lightweight and simple key carried by a store clerk, and which can be easily relocked onto the hook without the use of the key.

Another object is to provide a security lock of the type described which employs a relatively few number of parts that can be inexpensively fabricated from synthetic plastic materials.

The invention in summary provides a security lock which includes a housing having an internal cavity in which a cradle is formed for seating the upturned tip of a hook of the type adapted for mounting onto a pegboard or other support. A slot is formed in the housing for enabling ingress and egress of the hook tip into the cavity for seating within or removal from the cradle. A latch is mounted in the housing for movement to a latched position at which the hook tip is captured in its seated position within the cradle. The latch is releasably held in its latched position, and it is operated by a key for movement toward an unlatched position for enabling the hook tip to be unseated from the cradle for egress out of the cavity. In its unlatched position, a portion of the latch is exposed through an opening in the housing where it can be manually operated for moving the latch back to its latched position.

The foregoing and additional objects and features of the invention are set forth in more detail in the following description in which the several embodiments have been explained in conjunction with the accompanying drawings.

DESCRIPTION OF THE PREFERRED EMBODIMENTS

Figure 1:
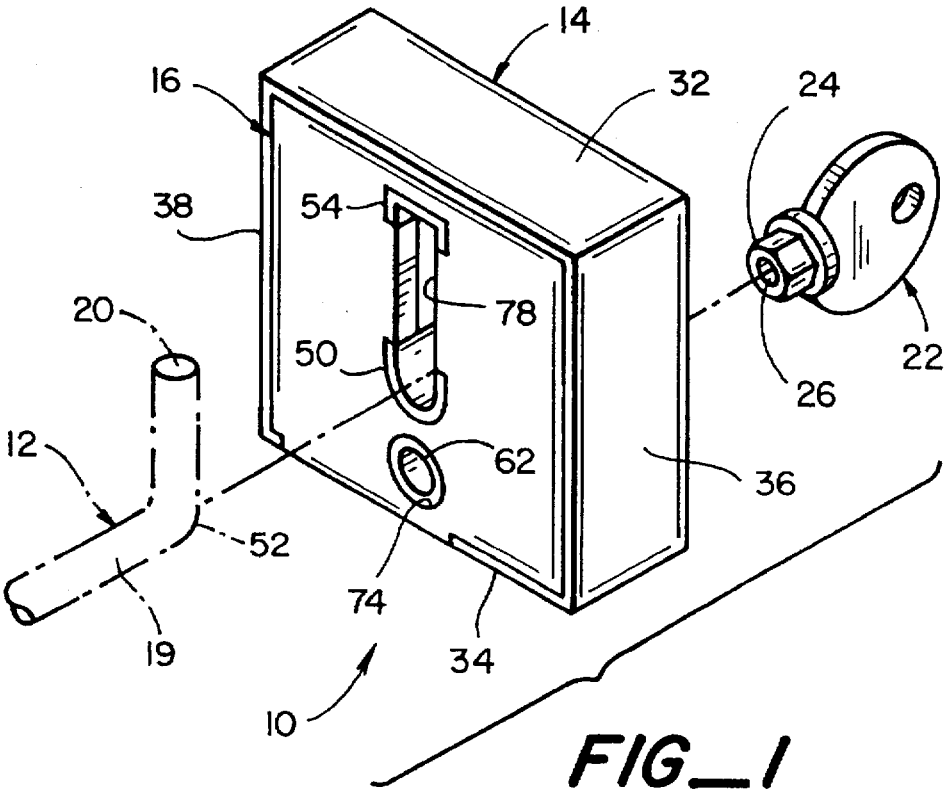
FIG. 1 is a perspective view illustrating a security lock in accordance with a preferred embodiment of the invention.

In the drawings FIG. 1 illustrates generally at 10 a preferred embodiment of the security lock for releasably securing merchandise products, not shown, onto a hook 12 of the type which is adapted for mounting on a pegboard or other suitable support, such a wire grid or wire slot, also not shown. Typically the products to be displayed are small merchandise items of the type sold in retail stores or supermarkets. Such products are usually carried on card stock having holes or apertures punched at the top for spindling on the hooks. The products, with or without the card stock, can be encased in a clear plastic enclosure, such as a plastic blister pack or clam shell package. As used herein, the term "products" means merchandise items which can be mounted on pegboard hooks with or without packaging.

Security lock 10 is comprised of three principal components: housing 14, back plate 16 and latch 18. The three lock components can advantageously be molded from a suitable lightweight and strong synthetic plastics material, such as polycarbonate. In FIG. 1 lock 10 is shown in relationship to the distal end portion of the pegboard hook 12.

The proximal end (not shown) of the hook is suitably formed for attachment to the pegboard or other support, and the hook comprises a horizontal metal rod 19, typically of 3/16 diameter, having a hook tip 20 which projects upwardly at right angles from the horizontal portion.

FIG. 1 also illustrates a tamperproof key 22 for use with the lock, and the key can be molded from a suitable plastics material such as polycarbonate. The key is molded with a male shank 24 having a predetermined cross-section, shown as hexagonal. A bore 26 is formed along the centerline of the shank.

Figure 2:
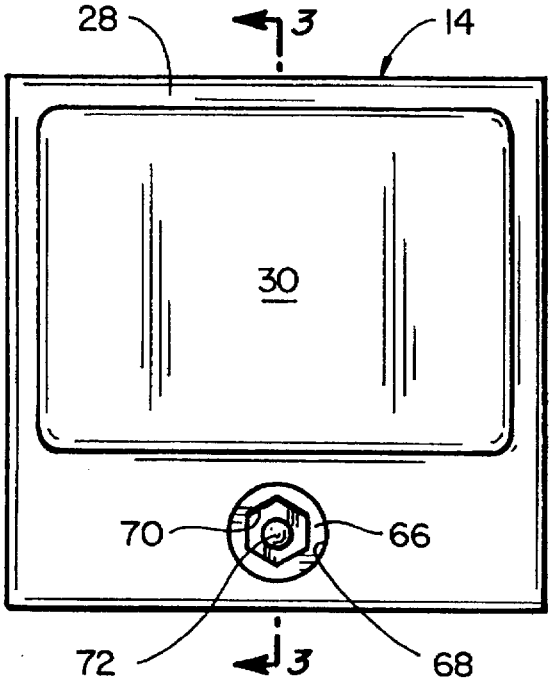
FIG. 2 is a front elevation view of the lock of FIG. 1.
Figure 3:
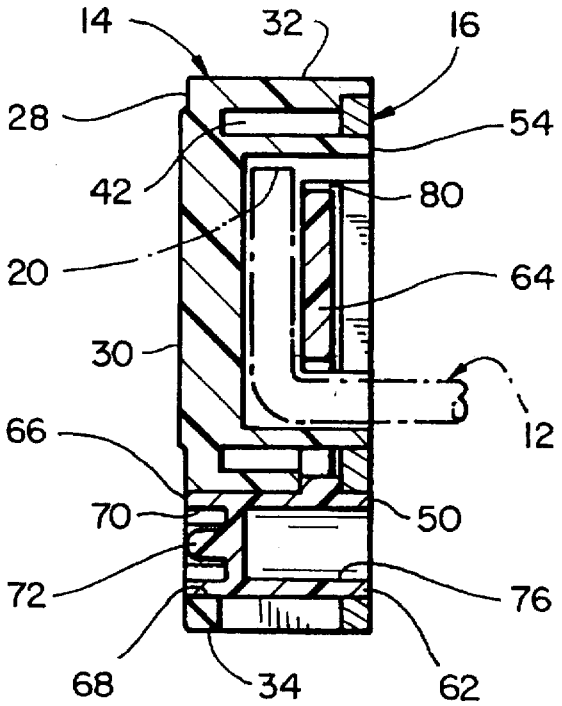
FIG. 3 is a vertical cross-section view taken along the line 3—3 of FIG. 2 showing the latch in its latched position.

As best illustrated in FIGS. 2 and 3, housing 14 is molded with a front wall 28 providing a uniformly flat surface area 30 which faces the customer when the lock is mounted on the hook. The flat surface area is adapted for receiving printed indicia such as a store logo, product description or other messages intended to be read by the customers. Integrally formed around the periphery of the front wall are a top wall 32, bottom wall 34 and a pair of side walls 36, 38. An opening 40 (FIGS. 4 and 6) is formed through a portion of the bottom wall. The peripheral walls together with the front wall combine to define a cavity 42 in which the latch 18 is mounted. The inner surface of front wall 28 is integrally molded with the a reticulated grid of ribs 44, 46 which strengthen the housing. At three of the housing corners holes 47 are formed in the rib structure with holes sized for receiving suitable attachment pins, not shown, which are mounted on back plate 16.

The inner surface of front wall 28 is also molded to form an integral cradle 48 which is sized and shaped for seating hook tip 20. Cradle 48 is comprised of a lower U-shaped portion 50 which is sized for fitting about and seating the bight portion 52 of the hook tip. The cradle further is comprised of an upper portion 54 having downwardly extending rims 56 adapted to fit about the upper end of the tip. The cradle includes a pair of vertically extending side walls 58, 60 which are spaced apart commensurate with the diameter of the hook tip.

Latch 18 is comprised of a cylindrical hub 62 which is integrally formed with a flat tongue 64. As shown in FIG. 3, one end 66 of the hub rotatably fits within a circular opening 68 formed at the lower end of housing front wall 28. Back and forth rotational movement of the hub within opening 68 causes the latch to pivot about axis 86 between the latched position shown in FIG. 6 and the unlatched position shown in FIG. 4. Hub end 66 is formed with a female keyway 70 having a cross-section, shown as hexagonal, which is commensurate with the cross-section of key shank 24. A center pin 72 is integrally formed with the hub and is coaxial within the keyway. This pin is sized commensurate with bore 26 of the key shank for enabling insertion of the key. The pin minimizes the chance of tampering in that it prevents insertion of the end of a standard Allen head wrench.

Back plate 16 is formed at its lower end with a circular opening 74 which rotatably fits about the opposite end of the latch hub 62. A recess 76 is formed in this end of the hub for reducing its weight. A vertical aperture or slot 78 is formed in the back plate, and the aperture side walls are spaced apart sufficient to permit ingress and egress of the hook tip into and from housing cavity 42. A U-shaped enlargement is formed at the lower end of aperture 78 for snugly fitting about the outside margin of U-shaped portion 50 of the cradle. The upper end of the aperture is formed with an enlarged portion which snugly fits about the outer margin of the upper portion 54 of the cradle. The outer side margins of back plate 16 fit within grooves 79 which are formed around the inner edges of the housing top wall, bottom wall and side walls. Suitable means such as solvent bonding or sonic welding is used to secure the outer edges of the back plate to the housing wall and to also secure the outer portions of the cradle to the edges of aperture 78 formed in the back plate.

With back plate 16 assembled and bonded to the housing walls, a gap 80 (FIG. 3) is formed between the inner surface of the back plate and the pair of slots 58 and 60 which are formed at the front of cradle 48. The tip of latch tongue 64 is formed with a cross-section which is sized and shaped generally commensurate with the cross-section of this gap. As the latch is moved toward its latched position, the tongue 64 fits within this gap in the manner shown in FIGS. 3 and 6. With the hook tip seated in the recess formed by the cradle, and with the latch tongue fitted into gap 80, the hook tip is fixedly held within the cradle so that the lock is restrained against both longitudinal and rotational movement with respect to the hook.

Figure 5:
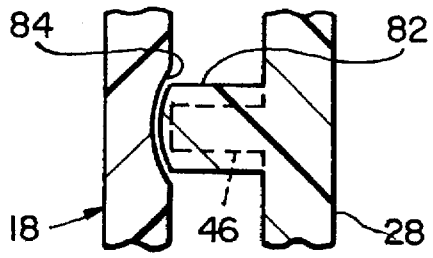
FIG. 5 is a fragmentary section view, to an enlarged scale, taken along the line 5—5 of FIG. 6.

Means is provided for holding the latch in its latched position and for also releasing the latch to move toward an unlatched position for enabling the hook tip to be unseated from the cradle for egress out of the cavity. This means comprises a nib 82 (FIG. 5) formed on a portion of the grid of housing ribs 46. The nib projects a short distance, on the order of 0.001", into the plane of the facing surface of latch 18. A depression 84 is formed on this facing surface of the latch, and the depression is sized and shaped commensurate with the nib. The radii of both the nib and depression from the latch pivot axis 86 are equal so that pivotal movement of the latch moves the depression along a path which carries it over the nib. The invention also contemplates that the nib could be formed on the latch and the depression formed on the facing surface of the housing rib.

Figure 6:
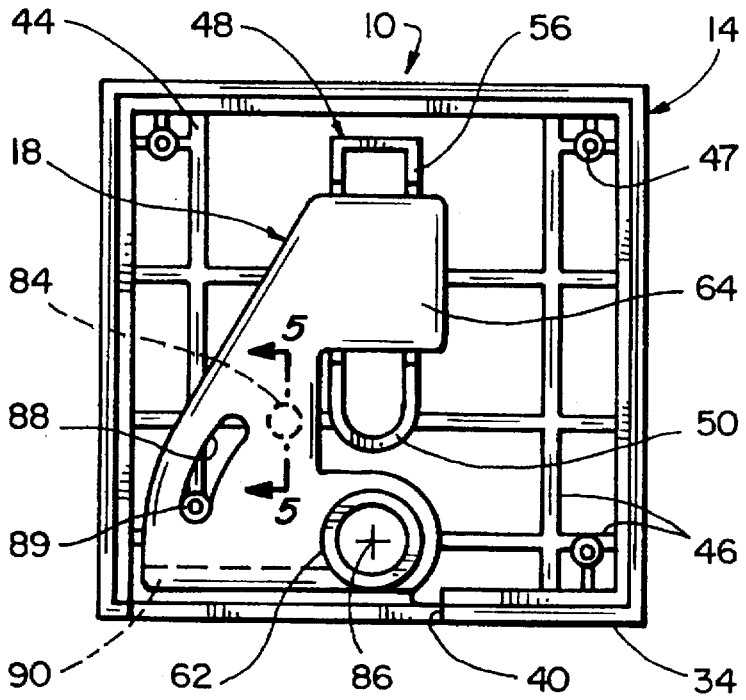
FIG. 6 is a rear elevation view similar to FIG. 4 showing the latch in its latched position.
Figure 7:
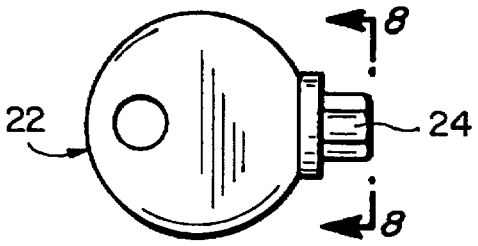
FIG. 7 is a side elevation view to an enlarged scale of the key shown in FIG. 1.
Figure 8:
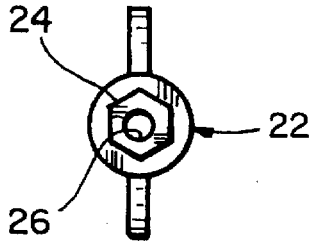
FIG. 8 is an end view of the key taken along the line 8—8 of FIG. 7.

When the latch is in its latched position of FIG. 6 the depression 84 and nib 82 are aligned so that the nib elastically snaps into the depression. The nib is formed with a convex surface and the depression is formed with a corresponding concave surface. This engagement of the nib into the depression releasably holds the latch in its latched position. When key 22 is inserted for turning the latch in a counterclockwise direction, as viewed in FIGS. 4 and 6, toward the unlatched position, the curved surfaces of the nib and depression provide a camming action which assists in moving the nib out of the depression for enabling the latch to rotate. A latch release opening or hollow or aperture 88, in the shape of an oval-shaped angular sector, is formed through the latch tongue. One of the ribs 46 carries an integrally formed protruding pin 89 which slidably fits within aperture 88. The aperture is sized and positioned to move into register with pin 89 when the latch is pivoted along a range of travel as it moves toward the unlatched position. Throughout this range of travel the pin is within aperture 88 so that it does not restrain latch movement. The invention contemplates that a recess could be formed on the inside surface of the latch in place of aperture 88 with the recess sized to permit free relative movement between the pin and recess as the latch is moving within its range of travel.

Figure 4:
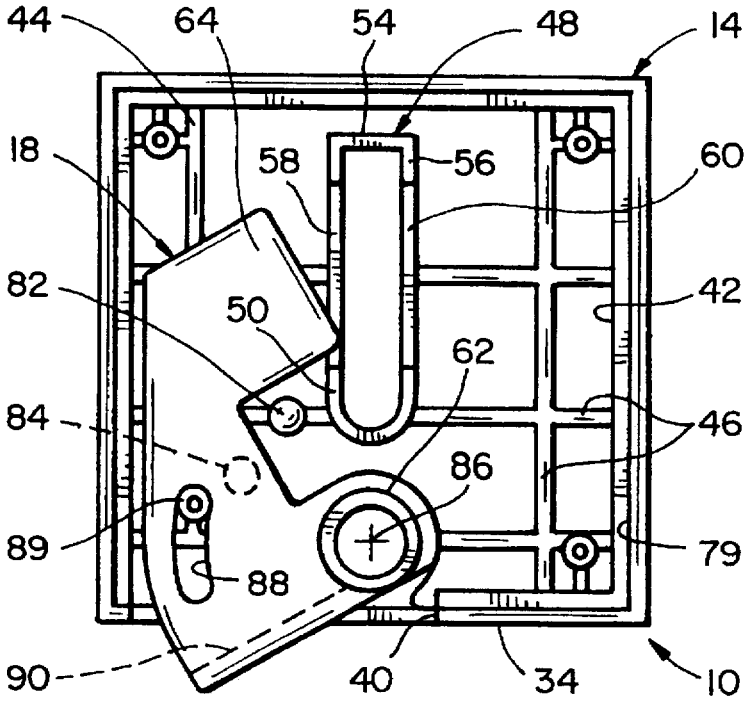
FIG. 4 is a rear elevation view of the lock of FIG. 3 showing the latch in its unlatched position.

An L-shaped operating portion 90 (FIGS. 4–6) is formed at the lower end of the latch, and this operating portion is sized to fit within housing opening 40 when the latch is in its latched position. When in the latched position the operating portion is recessed above opening 40 such that it is relatively inaccessible. This minimizes the risk of tampering. In the unlatched position as shown in FIG. 4 operating portion 90 projects partially out of the opening where it is exposed to view, thereby providing a visual indication or alert warning that the lock is in its released mode. The retail clerk or other user can then manually push upwardly against the operating portion and move the latch back toward its latched position. Lock 10 is thereby relatched without the need for using the key.

The initial step in the use and operation of lock 10 is in mounting it on the tip of a pegboard hook 12 onto which merchandise products have been spindled. With the lock held in the upright position shown in FIG. 1, and with latch 18 moved to its unlatched position, the lock is pushed toward the hook so that tip 20 is inserted through back plate aperture 78 and seated within cradle 48. The user then manually pushes up on the operating portion 90 of the latch to pivot the latch until nib 82 snaps into depression 84. This action causes latch tongue 64 to fit into the gap 80 between the hook tip and housing back plate 16. The lock is now securely held on the hook tip against both longitudinal and rotational movement. The lock remains fixed in upright position so that surface area 30 is held in an upright plane facing the customer for display of the store logo, product description or other indicia. When locked in place, the sharp end of the hook tip is completely covered by the lock housing, thereby providing an important safety function in preventing injuries to eyes and the like of customers and store personnel. This obviates the need and expense of prior efforts to prevent these injuries, such as the use of balls on the end of hook tips, or the use of relatively expensive safety hooks having double rods which are joined on their outer ends with a loop.

When in place lock 10 prevents unintended withdrawal of merchandise from the pegboard hooks, and thereby reduces theft losses to the retailer. The invention also minimizes tampering in that when the latch is in its latched position operating portion 90 is withdrawn upwardly into opening 40 where it is relatively inaccessible.

When it is desired to remove the lock to withdraw merchandise from the pegboard hook, the user inserts key shank 24 into keyway 70 at the end of hub 62. The key is then turned for moving the latch counterclockwise from the position shown in FIG. 6. The turning torque applied to the latch causes depression 84 in the latch to cam out of its engaged relationship with nib 82. Further movement of the latch carries aperture 88 over the nib, which frees the latch so that it can then pivot down to its fully unlatched position, and the key can then be withdrawn. Lock 10 is then pulled away from the hook tip and the selected merchandise pulled off the hook, afterwhich the lock can be pushed back on the hook and relatched.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A lock for use with a key to secure merchandise products onto a hook of the type having an upturned hook tip on the end of an elongate rod which is adapted for mounting onto a pegboard or other support, the lock comprising the combination of a housing having an internal cavity, said housing including a bottom having an opening, means providing a cradle within said cavity for seating said hook tip, means providing a slot in the housing for enabling ingress of said hook tip into the cavity to a seated position for a lock latched mode, said slot further enabling egress of said hook tip from the cradle and out of the cavity for a lock released mode, latch means comprising a latch moveable to and from a latched position at which the hook tip is captured in said seated position in the cradle, means for releasably holding the latch in said latched position and for enabling the latch to move toward an unlatched position for enabling the hook tip to be unseated from the cradle for egress out of the cavity, said latch including an operating portion which projects at least partially out of said opening when the latch is moved away from said latched position whereby the operating portion is exposed to a user who can push the operating portion for moving the latch back toward said latched position, said operating portion being in a position withdrawn from said opening completely within said housing when the latch is in said latched position for minimizing the risk of unauthorized tampering with the lock, and means responsive to operation of said key for moving the latch toward said unlatched position.

* * * * *